US007357700B2

(12) United States Patent
Lundberg et al.

(10) Patent No.: US 7,357,700 B2
(45) Date of Patent: Apr. 15, 2008

(54) RIDING FLOOR POLISHING AND GRINDING MACHINE FOR TREATING CONCRETE, TERRAZZO, STONE AND SIMILAR SURFACES

(75) Inventors: Thomas David Lundberg, Forney, TX (US); Mitchell Stanley Withem, Haltom City, TX (US)

(73) Assignee: Badger Machine Company, Dallas, TX (US)

( * ) Notice: Subject to any disclaimer, the term of this patent is extended or adjusted under 35 U.S.C. 154(b) by 0 days.

(21) Appl. No.: 11/663,897

(22) PCT Filed: Sep. 24, 2004

(86) PCT No.: PCT/US2004/031623

§ 371 (c)(1),
(2), (4) Date: May 21, 2007

(87) PCT Pub. No.: WO2006/036143

PCT Pub. Date: Apr. 6, 2004

(65) Prior Publication Data

US 2007/0264917 A1 Nov. 15, 2007

(51) Int. Cl.

| | |
|---|---|
| ***B24B 23/00*** | (2006.01) |
| ***B24B 27/08*** | (2006.01) |
| ***B24B 1/00*** | (2006.01) |
| ***B24B 19/00*** | (2006.01) |

(52) U.S. Cl. ..... 451/353; 451/350; 451/352; 451/434; 451/60

(58) Field of Classification Search ..... 451/350, 451/352, 357, 359, 434, 60; 15/98
See application file for complete search history.

(56) References Cited

U.S. PATENT DOCUMENTS 6,425,169 B1 * 7/2002 Briscoe ..... 29/90.01

FOREIGN PATENT DOCUMENTS

EP 353997 A2 * 2/1990

* cited by examiner

*Primary Examiner*—Joseph J. Hail, III
*Assistant Examiner*—Bryan Muller
(74) *Attorney, Agent, or Firm*—Hemingway & Hansen, LLP; D. Scott Hemingway

(57) ABSTRACT

The invention is a riding floor polishing and grinding machine that uses one or more gangs of polishing heads (242) to treat concrete and similar surface flooring (208). A compact vehicle (210) equipped with a front loader arm (235) is fitted with a module (240) containing the gang(s) of polishing head. The vehicle (210) is capable of raising and rotating the module to easily change the pads attached to the polishing heads. Each polishing head is individually powered by a motor and floats over the floor surface. The pads attached to the polishing heads can be of many different types, preferably diamond-impregnated polishing pads. The invention enables operator to more quickly and efficiently remove material from a floor surface. The design also enables gangs of pads to be mounted with different grit ratings to perform different treatment operations using a single machine in a single pass over a floor surface.

23 Claims, 7 Drawing Sheets

RIDING FLOOR POLISHING AND GRINDING MACHINE FOR TREATING CONCRETE, TERRAZZO, STONE AND SIMILAR SURFACES

TECHNICAL FIELD OF THE INVENTION

A heavy-duty vehicle for grinding, polishing, and/or finishing concrete, terrazzo, stone, and similar surfaces.

BACKGROUND OF THE INVENTION

Portland cement was invented in 1824 by Englishman Joseph Aspdin, which became and has remained the dominant cement used in concrete construction. Concrete consists of a hard, chemically inert aggregate substance composed of sand and gravel bonded by cement and water. Aggregates found in concrete can include sand, crushed stone, gravel, slag, ashes, burned shale, crushed glass, and burned clay. Fine aggregate (fine refers to the size of aggregate) is used in making concrete slabs and smooth surfaces such as floors, while coarse aggregate is used for large structures or sections of cement.

Over recent years, concrete and similar type flooring has enjoyed increasing popularity with expanding usage in both commercial and residential construction. Recent advances in polishing equipment and techniques allow contractors to grind and polish concrete or similar floor surfaces to a high-gloss finish that minimizes the need for waxes or coatings. If concrete is to be polished, an array of aesthetic options are available. Colored aggregate can be applied to the concrete mix or added to the top layer of the mix. Concrete treated in this manner can be polished to a smooth, high-luster finish and stained to resemble the look of polished stone surfaces such as marble, granite, tile, or terrazzo. To replicate the color of stone, stain or other dyes can be added to the concrete during the polishing process or integrally added to the concrete mixing process. The polishing process can reveal added aggregates, such as glass, seashells, nails, bolts, computer chips, or any other objects that can be mixed with the concrete and then polished smooth to achieve a wide variety of aesthetic appearances.

Generally, an internal impregnating sealer is applied during the polishing process that sinks into the concrete to protect the concrete by hardening and densify the concrete to eliminate any requirement for topical coating. This treatment of the concrete reduces maintenance significantly and creates a concrete floor that is much more durable compared to other traditional floor surfacing such as wood, linoleum, tile, vinyl, or even some types of stone. Many treatment solutions fill in small cracks, gaps, and voids to strengthen and densify the concrete. This strengthening of the concrete floor surface permits superior shine because the subsequent polishing of the surface removes smaller bits of surface material. Using polishing solutions can also help fill in pores, micro cracks, and fissures that are opened or exposed during the polishing process, and the polishing solution helps to lubricate and clean the pads used to polish the concrete and achieve a superior finish and shine.

One of the recent developments in the art contributing to the increasing popularity of polished concrete and stone flooring is the diamond-impregnated polishing pad. The industrial diamond abrasive incorporated into these pads greatly increases the effectiveness and the efficiency of the polishing process, so much so that existing floor polishing and grinding machines cannot fully exploit the potentials of these state-of-the art polishing pads.

The diamond-impregnated polishing pads are much more effective and capable of stripping off material from the exposed surface of concrete and stone flooring to achieve a very smooth, high luster, polished surface. The diamonds in the pads can dig into the extruding surface material to a much greater degree compared to earlier pad types and can strip the extruding layer of material off much easier compared to pads previously available. The diamond impregnated pads can also continue to remove material more effectively at a given smoother grade of pad (e.g. grit rating) and achieve a smoother finish than identically rated pads.

Newer diamond-polishing technology now makes it possible to grind and polish concrete surfaces at up to 3000-grit finishes. These finely polished concrete floors are essentially no-maintenance flooring. Removing all previous treatments and then polishing the floor can be a one-time fix that reduces maintenance costs, minimizing any requirement for expensive waxes or other coatings. After diamond polishing, the only maintenance required is the removal of dirt, oils, and other foreign substances that can stain the concrete.

Currently, most vendors of stone or concrete floor polishing services use a conventional single-pad rotary buffer machine operated by a single worker with a diamond-impregnated polishing pad attached. Such machines are limited in effectiveness because of the limited size of floor area that can be polished and grinded in a given period of time. The limited size of the buffer's polishing "footprint" is but one factor in the limited efficiency of a single operator using a floor buffer. This inefficiency extends in large measure from an inability to fully exploit the enhanced polishing and grinding properties of the diamond-impregnated pads.

Also, the conventional single-pad floor buffer cannot exert sufficient vertical force onto the floor surface for the pad to dig into and grip the upper surface layer of the floor material for maximum grinding. Nor can a conventional single-pad buffer develop sufficient rotational power to strip off the upper surface layer of the floor material to a sufficient degree. It is also cost prohibitive to polish a very large floor area to the degree of smoothness now possible with the newer type of pads. Moreover, if a conventional buffer machine could fully exploit the pads' potential, the forces exerted against the operator would be such that the operator could not control the buffer. As such, it is difficult for an operator to control the buffer and achieve a uniform finish over large areas, often leaving inclusions or "swirling" visible in sections of the flooring.

Earlier efforts to improve upon the ability to exploit diamond-impregnated pads has usually centered upon modifying floor scrubber machine designs for use in polishing and grinding concrete and stone floor surfaces. However, such efforts have not been successful. Such modified machines lack the necessary rotational power, cannot exert optimal vertical pressure, and cannot effectively dispense polishing solution. One prior art machine specially designed for concrete grinding and polishing is the Draygon RGS50. The RGS50 is not a satisfactory solution because it fails to adequately dispense water or polishing solution. It is limited in its grinding wheel configuration, and the amount of vertical force applied to the grinding surface is not well-regulated.

Thus, the RGS50 has trouble performing the grinding operation without leaving inclusions, swirling, or other imperfections in the surface. The RGS50 also has a limited capacity for water or polishing solution.

There remains a requirement for a machine that possesses sufficient engine power to rotate pads with sufficient rotational force and sufficient and regulated vertical force to dig into the floor surface to remove material to the extent that diamond pads make possible, to cover a greater surface area during operation such that it is possible to grind and polish floor surfaces to a superior smoothness with greater efficiency and at a reasonable cost, and to achieve a uniform finish that is free of inclusions or swirl patterns. There is also a need for a machine that offers the ability to quickly and easily change pads upon use or from a coarse to a finer grit rating. There is also a need for a machine that possesses a center liquid feed to distribute water and polishing solution. Finally, there is a need for a machine that can perform dissimilar grinding and polishing operations in a single pass to vastly improve the time efficiency of the task.

SUMMARY OF THE INVENTION

The invention is a heavy-duty floor grinding and polishing vehicle that exploits the potential of diamond-impregnated polishing pads. The floor polisher is operated by a single rider who operates a compact vehicle with an attached and integrated sander/polisher head module. Four sander/polisher heads are mounted into a gang module with each head powered by an individual hydraulic motor. The hydraulic motors are coupled to a pump powered by the compact vehicle's power take off output shaft.

The gang module of four sander/polisher heads and their mounting frame are connected to the compact vehicle by front loader arms, often found on tractors. Mounting the gang module on the loader arms allows the mounting frame to lift and rotate so the gang module can be raised and tilted forward for easy removal to swap out the pads. The arms can apply more regulated vertical force on the grinding pads than previously available. Weights can be added to the module to provide sufficient vertical force onto the heads so that the pad's diamond abrasive can cut into the floor surface more effectively. The module is also mounted to tensioner arms to regulate the amount of vertical force delivered by the module to the floor surface. It is also possible to mount a second gang module with different grit-rated pads in place and perform two dissimilar floor treatment steps in the same operating pass.

Each of the heads is mounted onto a stationary center shaft that is center-drilled so that water and other treating solutions can be injected through the center of the spinning heads. Process water or other liquid solutions are fed from a 100 gallon or larger tank mounted on the back of the compact vehicle. A second storage tank is also mounted on the back of the compact vehicle and connected to a vacuum system that collects the used slurry generated by the grinding and polishing process. Alternatively, a single tank with two compartments can be used. A squeegee device on the back of the compact vehicle will also aid in collecting the slurry for vacuuming and cleaning the floor during the process.

BRIEF DESCRIPTION OF THE DRAWINGS

The objects and features of the invention will become more readily understood from the following detailed description and appended claims when read in conjunction with the accompanying drawings in which like numerals represent like elements and in which:

DETAILED DESCRIPTION OF THE PREFERRED EMBODIMENTS

Figure 1:
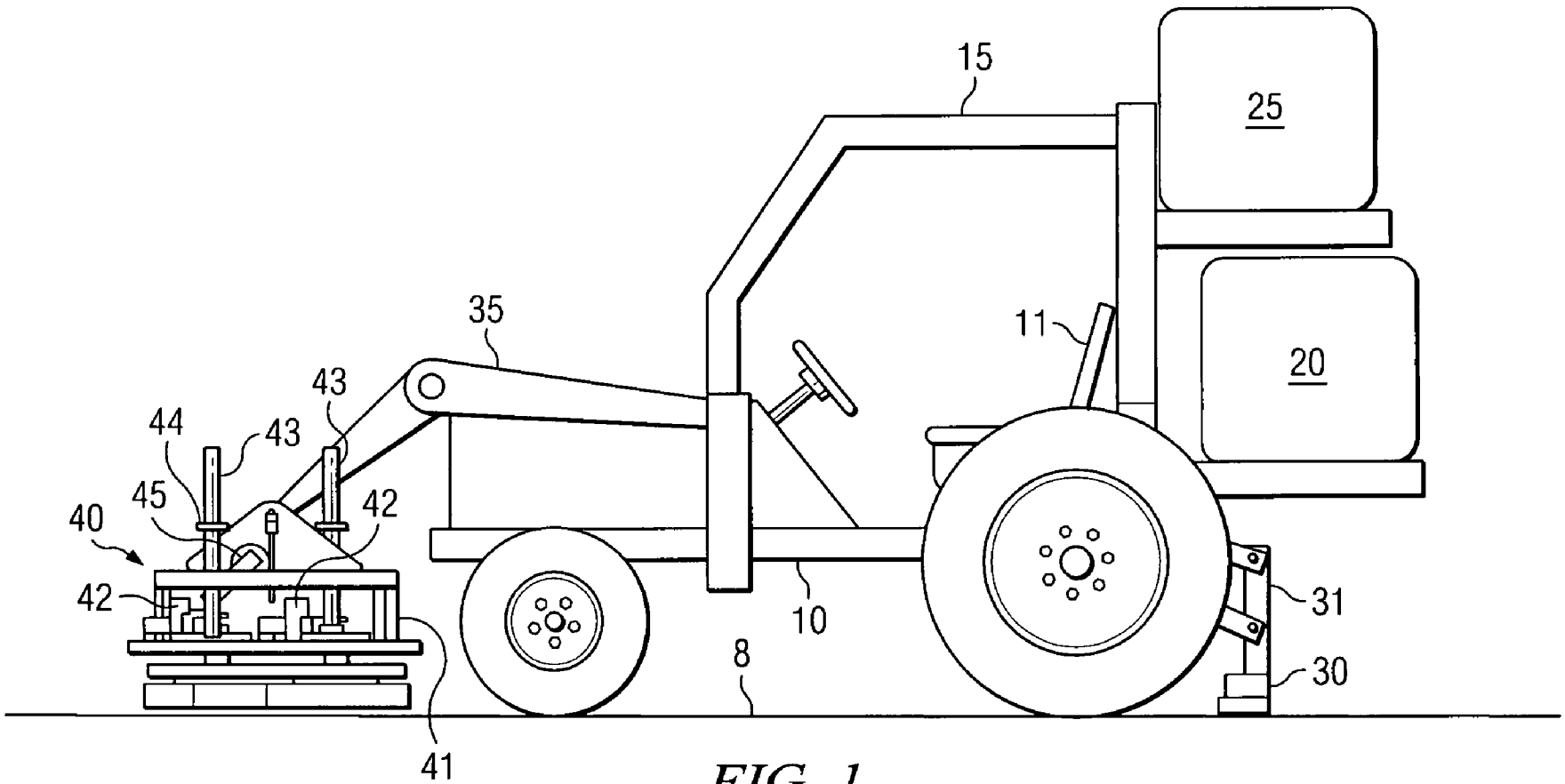
FIG. 1 is a side view of the invention with a module containing four polishing heads.

FIG. 1 is a side view showing the major elements of the inventions. The most prominent feature of the invention is the vehicle 10 that provides the essential structure for the invention. Although any basic small agricultural tractor with integrated or attached front loader arms and a power take off (PTO) output shaft can provide an acceptable base-line vehicle, the preferred embodiment utilizes a small or compact vehicle 10, preferably in the size range of 1200 to 2200 pounds, equipped with a 18 to 50 gross horsepower engine delivering at least 15 horsepower to the PTO output shaft. This size vehicle 10 has sufficient weight and power to properly grind and polish floors but is not so large as to be unwieldy and lack sufficient maneuverability for indoor applications, such as polishing the flooring in a warehouse, convention center, church, or even large residential house or multi-family dwelling. It may also be used on many construction jobs on upper floors and is not limited to just a ground floor. A smaller vehicle can be used and may be more useful for upper floors in multi-story buildings, but a vehicle weighing less than 1000 pounds and having a gross horsepower rating of less than 15 cannot achieve the efficiency that is the goal of the invention. Examples of acceptable tractors meeting this size and power requirement are the Kubota B2410 and B7410, the Massey-Ferguson GC2300, MF1423, and 1428, the John Deere 4110 and 4115, the New Holland TC21DA and TC30, and the Case DX21 and DX24. Each of these tractors delivers at least 15 horsepower to the PTO output shaft, grosses at least 1200 pounds, and is equipped with at least an 18 horsepower engine. Total weight with grinding module 40, tanks 20 and 25, and other items mounted will be over 1700 pounds for these small tractors.

Two further advantages of using a standard tractor vehicle versus a specialized machine are increased versatility and maneuverability. This design can freely move between different buildings or work areas over unimproved ground on a job site very easily. In contrast, the Draygon RGS50 and converted sweepers are not well suited to move across unimproved ground and can become bogged down in muddy terrain, which is not an obstacle to the vehicle 10 used in the invention.

The vehicle 10 has an attached safety cage 15 to protect the driver in the seat 11 in the event of a rollover. Alternatively, the cage 15 may be deleted. A first 100 gallon tank 20 holds water or polishing solution used to provide lubrication and other treatment elements, such as water-dissolved, silicate-based, hardening, densifying, and abrasive solution. Treating a concrete floor 8 with the densifying and hardening solution helps to cure the concrete to a harder surface finish by improving the silicon bonds within the concrete floor 8 and filling in pores, small cracks, gaps, and voids on and close to the surface of the concrete floor 8. This strengthening of the concrete floor surface 8 permits superior shine because the subsequent polishing of the surface removes smaller bits of surface material and exposes much smaller pores. Using the silicate as a polishing solution also helps to fill in micro cracks and fissures that are opened or exposed during the polishing process. The result is a superior finish on a harder and more durable surfaced floor 8.

A second 100 gallon tank 25 is connected to a vacuum system for suctioning up the slurry solution generated during the polishing process from the use of either water or a silicate solution as a polishing medium or any other liquid chemical that may be used in the floor treatment. A squeegee 30 installed on the vehicle's three-point hitch 31 helps to collect the slurry solution into the vacuuming system. This more effectively cleans up the silicate and other waste material in the slurry so that possible environmental hazards due to subsequent run-off while washing the floor 8 to clean off this residue are reduced and minimized. The squeegee 30 can be raised or lowered to make contact or not make contact with the floor 8 and to adjust the surface pressure and generated surface contact. Alternatively, the tanks and/or associated vacuuming system can be mounted on a towed trailer behind the vehicle.

A pair of front loader bucket arms 35 is integrated into the vehicle 10. These two front loader arms are raised and lowered using the conventional controls for this purpose on the vehicle 10. Mounted at the end of the loader arms is a floor polishing head module 40. The floor polishing head module 40 includes a tubular metal frame 41 and vertical shafts 43 extending upward from each polishing head that receive a variable number of removable, stackable weights 44 permitting an operator to adjust the vertical pressure the invention can passively exert onto a floor surface 8. A variable number of polishing heads 42 are mounted to the metal frame 41. The front loader arms 35 can apply a vertical force on the polishing head module 40 and polishing heads 42.

An important innovation to the invention is the pivot mount 45 used to mount the polishing head module 40 to the vehicle 10. Using the standard hydraulic controls for the arms 35, an operator can raise the polishing head module 40 off of the floor surface 8 and rotate the polishing head module 40 for easy access to the pads on the polishing head. This enables a user to quickly and easily swap pads for either a fresh set of pads or to step to a higher grit rated (e.g. finer grit) pad. All an operator has to do is raise up the arms 35, rotate the polishing head module 40, and then remove the current pads and install the desired pads. This ability to raise the module 40 also contributes to the superior mobility of the invention, because the module 40 can be raised well clear of obstacles, which lessens the chances of a damaging impact by the module 40 with some obstruction during operation or while moving between job sites. The polishing head module 40 is also easily removable and replaceable, allowing a single vehicle to operate using one of several possible module designs, such as a three-polishing head, four-polishing head, six-polishing head, or eight-polishing head sized module 40. The module 40 can also be loaded with supplemental weights to increase vertical force on the module and increase grinding power.

Figure 2:
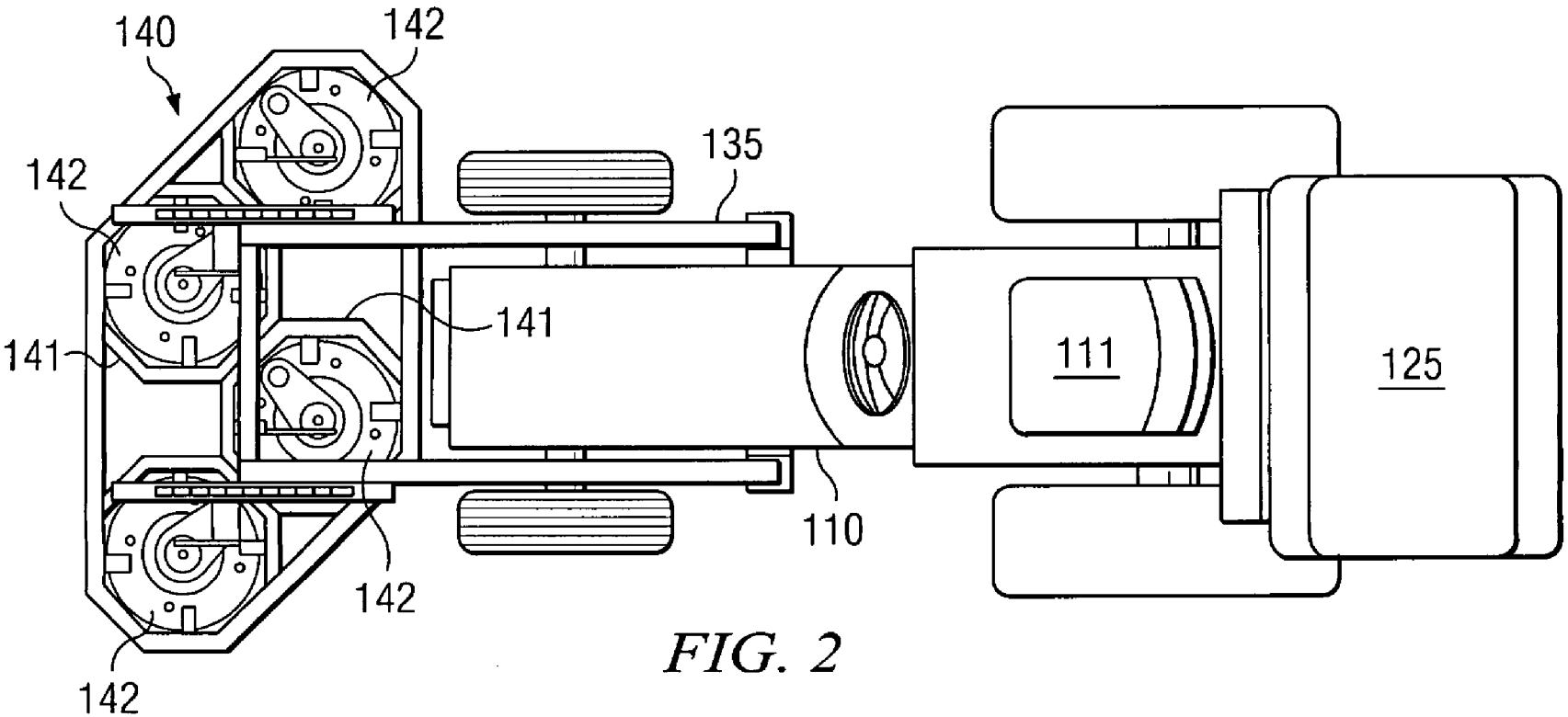
FIG. 2 is an overhead view of FIG. 1.

FIG. 2 is an overhead view of the invention as depicted in FIG. 1. The vehicle 110 has a seat 111 and driver position for a single operator. The operator can access the various power and hydraulic controls from this position to operate the various components of the invention. The 100 gallon tank 125 holds either water or a treatment/polishing solution to eject onto the floor during operation. The front loader bucket arms 135 are fully integrated into the vehicle 110 with operational controls reachable from the operator's seat 111. The polishing head module 140 is mounted onto the end of the front loader bucket arms 135. In this embodiment, the tubular metal frame 141 supports four mounted polishing heads 142. Mounting the four-polishing-head module 140 on the end of the front loader bucket arms 135 is superior to a mid-mounted location underneath the mid-line of the vehicle 110, because the module 140 can be easily raised and rotated for pad swap-out, the individual polishing heads 142 can be more easily accessed for maintenance, repair, or replacement, the module 140 can be maneuvered into areas that a mid-mounted location would not permit, and the module 140 can be swapped easily and quickly.

Figure 2A:
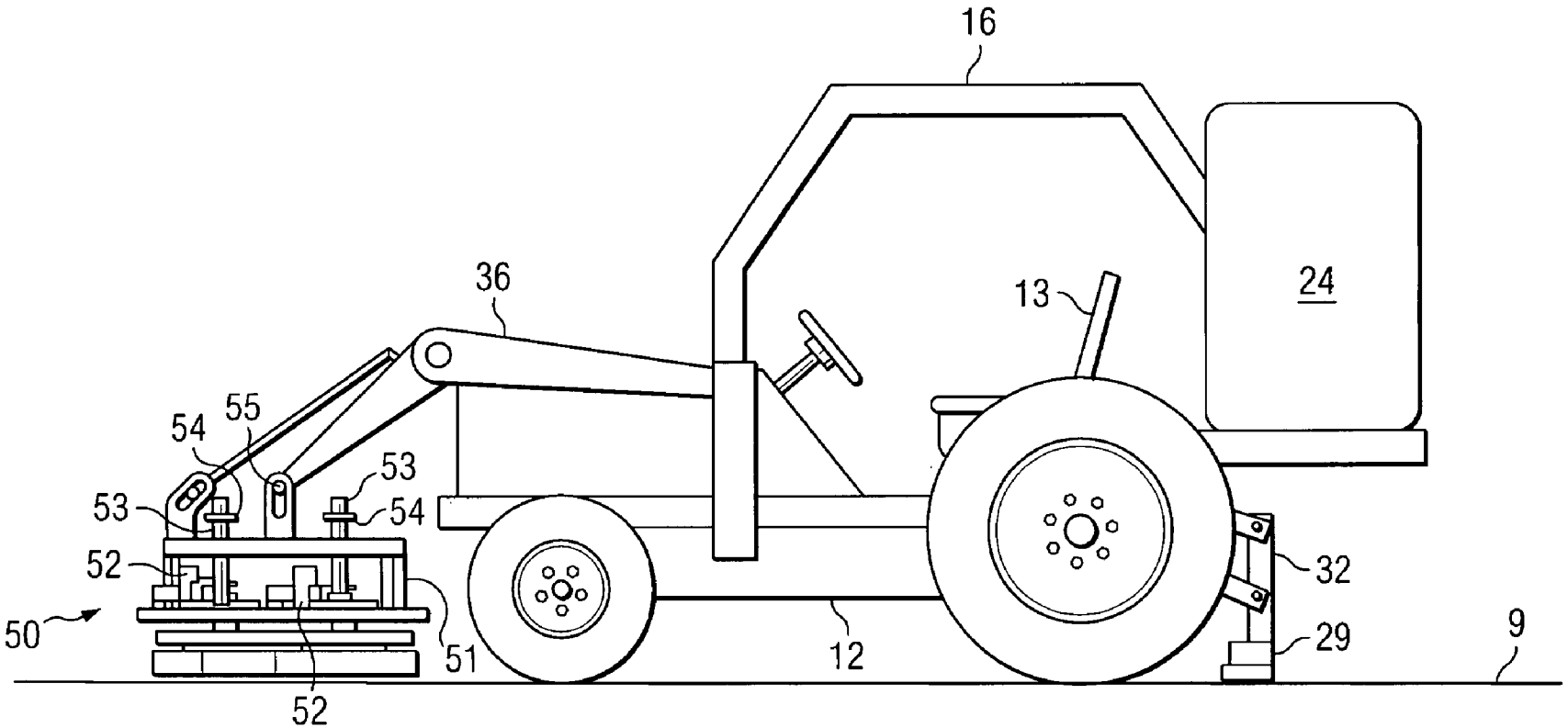
FIG. 2A is side view of an alternative embodiment of FIG. 1 using a single tank mounted on the back.

FIG. 2A is a side view of an alternative embodiment of FIG. 1 using a single tank on the rear of the vehicle. The vehicle 12 has an attached safety cage 16 to protect the driver in the seat 13 in the event of a rollover. In an alternative embodiment, the safety cage 16 can be deleted. A single 200 gallon tank 24, preferably fabricated from plastic and divided into two compartments. One compartment holds water or polishing solution used to provide lubrication and other treatment elements, such as water-dissolved, silicate-based, hardening, densifying, and abrasive solution. The second compartment is connected to a vacuum system for suctioning up the slurry solution generated during the polishing process of the floor 9 from the use of either water or a silicone-based solution or any other liquid used in the floor treatment. A squeegee 29 installed on the vehicle's three-point hitch 32 helps to collect the slurry solution into the vacuuming system. The squeegee 29 can be raised or lowered to make contact or not make contact with the floor 9 and to adjust the surface pressure and generated surface contact. Alternatively, a single tank with two compartments and/or associated vacuuming system can be mounted on a towed trailer behind the vehicle.

A pair of front loader bucket arms 36 is integrated into the vehicle 12. These two front loader arms are raised and lowered using the conventional controls for this purpose on the vehicle 12. Mounted at the end of the loader arms is a floor polishing head module 50. The floor polishing head module 50 includes a tubular metal frame 51 and vertical shafts 53 extending upward from each polishing head that receive a variable number of removable, stackable weights 54 so the vertical pressure exerted onto the floor surface 9 can be adjusted. A variable number of polishing heads 52 are mounted to the metal frame 51. The front loader arms 36 can apply a vertical force on the polishing head module 50 and polishing heads 52.

Figure 3:
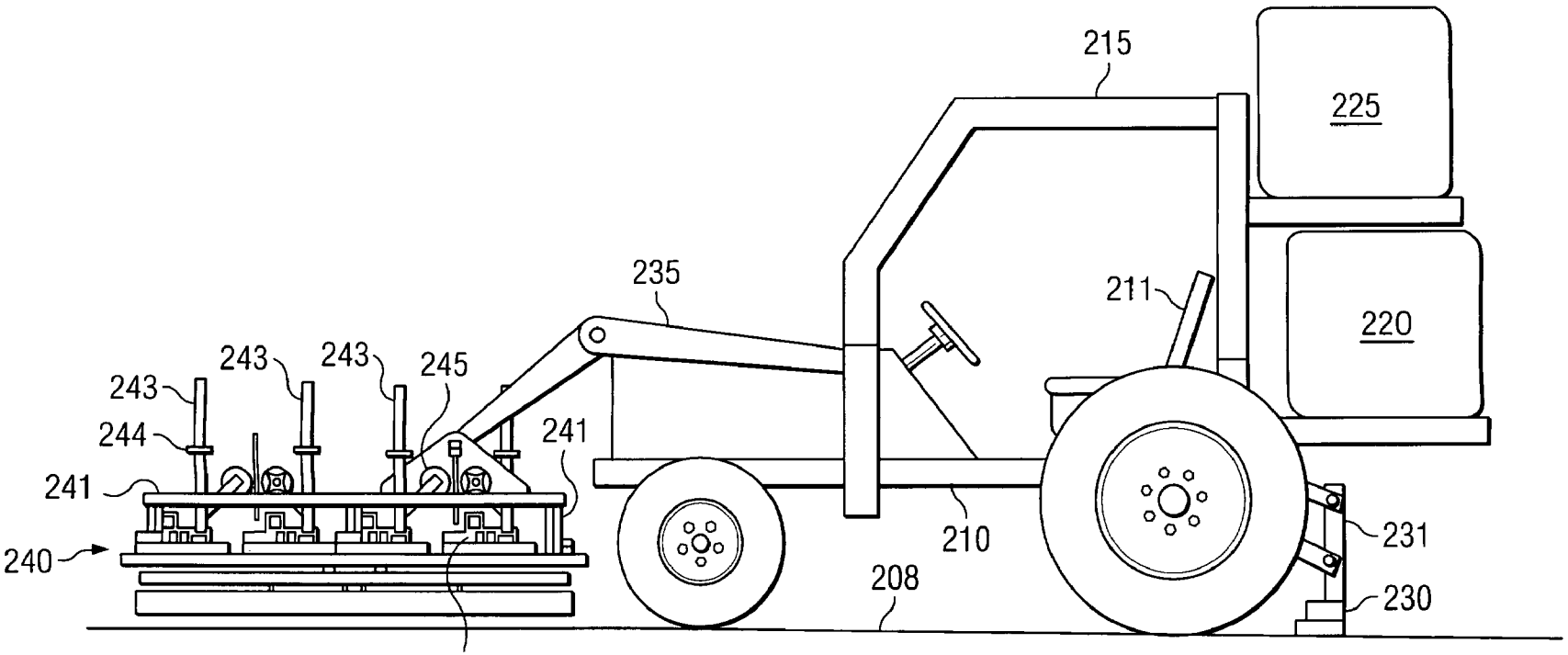
FIG. 3 is a side view of the invention with a module containing eight polishing heads.

FIG. 3 is a side view for another embodiment of the invention. The vehicle 210 has an attached safety cage 215 to protect the driver in the seat 211 in event of a rollover. Alternatively, the safety cage 215 can be deleted. A first 100 gallon tank 220 holds water or polishing solution used to provide lubrication and other floor treatment solutions, such as a water-dissolved, silicate-based, hardening, densifying, and abrasive solution for treating the floor 208. Using the solution during floor grinding and polishing permits superior shine because the subsequent polishing of the surface removes smaller bits of surface material. The result is a superior finish on a harder and more durable surfaced floor 208.

A second 100 gallon tank 225 is connected to a vacuum system for suctioning up the slurry solution generated during the polishing process from the use of either water or a silicate solution as a polishing medium. A squeegee 230 installed on the vehicle's three-point hitch 231 helps to collect the slurry solution into the vacuuming system. This more effectively cleans up the silicate and other waste material in the slurry so that possible environmental hazards due to subsequent run-off while washing the floor 208 to clean off this residue are reduced and minimized. The squeegee 230 can be raised or lowered to make contact or not make contact with the floor 208 and to adjust the surface pressure and generated surface contact. As shown in FIG. 2A, alternatively a single two-compartment tank can be used or the mounted tanks substituted or even supplemented by a towed trailer.

A pair of front loader bucket arms 235 is integrated into the vehicle 210. These two front loader arms are raised and lowered using the conventional controls for this purpose on the vehicle 210. Mounted at the end of the loader arms 235 is a floor polishing head module 240. The floor polishing head module 240 includes a tubular metal frame 241 and vertical shafts 243 extending upward from each polishing head 242 to receive a variable number of removable, stackable weights 244 permitting an operator to adjust the vertical pressure the invention can passively exert onto a floor surface 208. A variable number of polishing heads 242 are mounted to the metal frame 241, and in this embodiment a total of eight polishing heads 242 are mounted in the metal frame 241.

The pivot mount 245 enables an operator to use the standard hydraulic controls for the arms 235 to raise the polishing head module 240 off of the floor surface 208 and rotate the polishing head module 240 for easy access to the pads on the polishing head 242. A user can easily swap pads for either a fresh set of pads or to step to a higher grit rated (e.g. finer grit) pad. All an operator has to do is raise up the arms 235, rotate the polishing head module 240, and then remove the current pads and install the desired pads.

Figure 4:
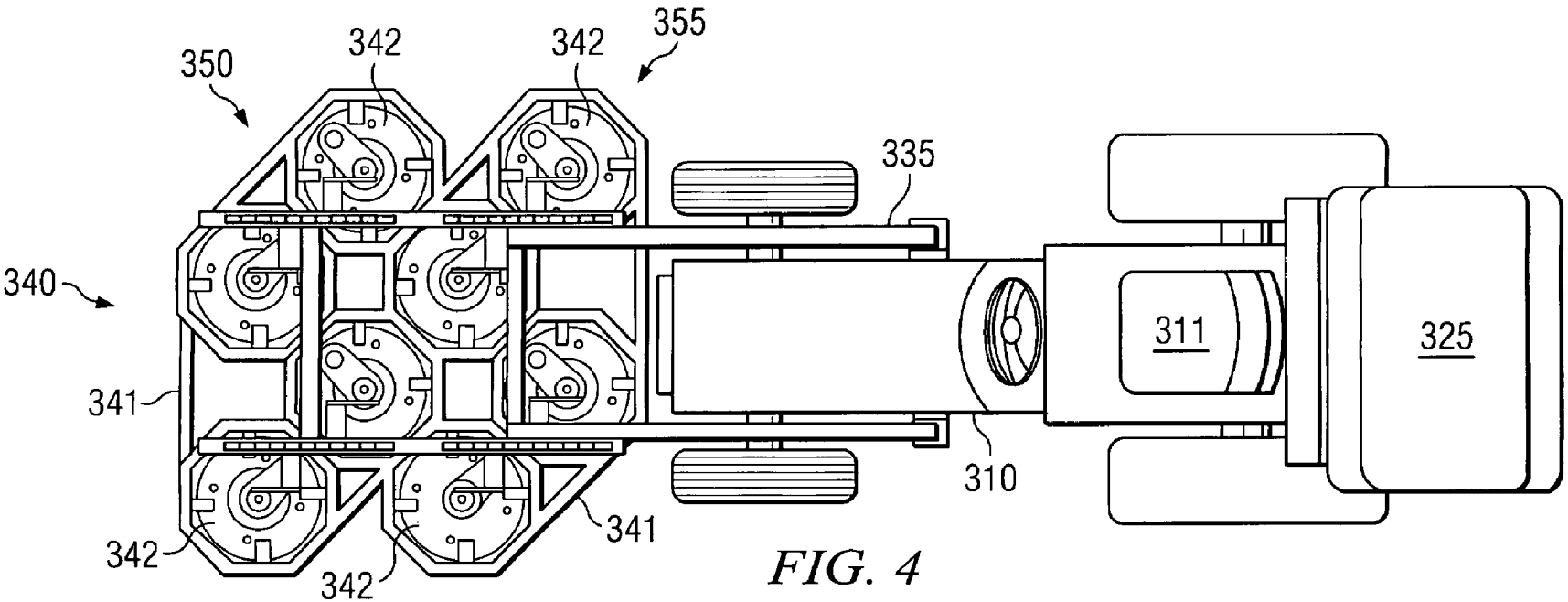
FIG. 4 is an overhead view of FIG. 3.

FIG. 4 is an overhead view of the invention as depicted in FIG. 3. The vehicle 310 has a seat 311 and driver position for a single operator. The operator can access the various power and hydraulic controls from this position to operate the various components of the invention. The 100 gallon tank 325 holds either water or a treatment/polishing solution mixture to eject onto the floor during operation. The front loader bucket arms 335 are fully integrated into the vehicle 310 with operational controls reachable from the operator's seat 311. The polishing head module 340 is mounted onto the end of the front loader bucket arms 335. In this embodiment, the tubular metal frame 341 supports eight mounted polishing heads 342. The eight polishing heads 342 are organized as two separate 4-head gangs. The front gang 350 can be fitted with polishing pads of a coarse grit that removes relative large bits of material from the floor in a single pass. The second gang 355 can be fitted with pads of a finer grit that remove relatively smaller, and finer, bits of material so separate floor treatment operations, such as a grinding treatment and a polishing treatment, can be performed in a single pass over a floor surface, with gang 350 performing the grinding or other treatment operation and gang 355 performing the polishing or another treatment operation. Two polishing operations can also be accomplished with gang 355 fitted with finer grit rated pads compared to the pads on gang 350.

Figure 5:
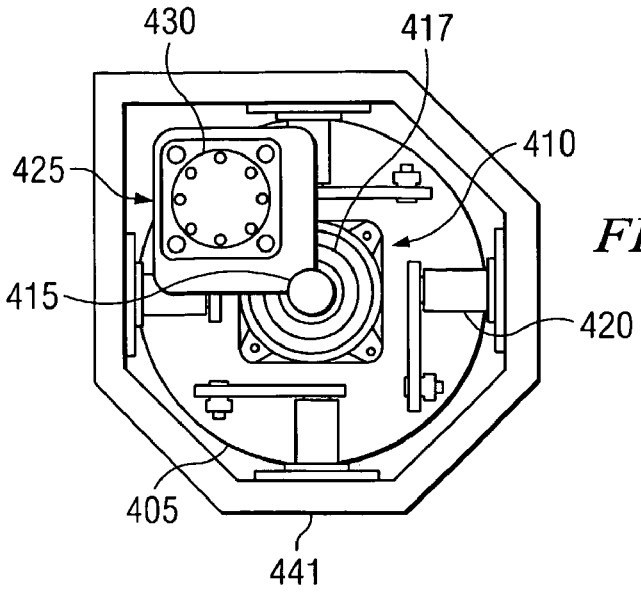
FIG. 5 is an overhead view of a polishing head.

FIG. 5 is a top view of a polishing head with more detail on the construction of the polishing head component. The sanding head that the pads or planetary disc drive attach adjacent to is basically a ¼ inch thick steel base plate 405. Tensioner arms 420 support the base plate 405 off from the tubular frame 441. The tensioner arm 420 incorporates a rubber sleeve that allows the steel base plate 405 to "float" within the tubular frame 441. The base plate 405 basically supports the entire remainder of the polishing head assembly.

A planetary drive disc is usually mounted adjacent to the lower surface of the base plate 405 so the counter-rotating pads rotate around a stationary center shaft 415 and are turned using a tubular housing 417 with a bolting flange and flange bearing 410 welded on the end. The tubular housing 417 fits over the stationary shaft 415 and has a bearing on each end. The bolting flange and flange bearing 410 is bolted into the center of the base plate 405 to slide over the tubular housing 417, anchoring the tubular housing 417 to the base plate 405 while allowing it to rotate around the center shaft 415. The tubular housing 417 is powered by a timing belt style drive system mounted near the top of the tubular housing 417 with a mating belt sprocket mounted on the output shaft of a hydraulic motor 430. This hydraulic motor 430 is installed on a bracket 425 welded to the top of the base plate 405.

In operation, the hydraulic motor 430 output shaft rotates the tubular housing 417, which extends down through the base plate 405 to terminate at an attachment point on the bearing at the end that connects the planetary drive disc and/or pads. The hydraulic motor 430 is connected by hydraulic lines to a pump powered by the PTO output shaft on the vehicle. A speed control accessible by the operator permits the operator to adjust the speed of rotation (revolutions per minute or RPM) of the rotating pads to an optimal rate depending on the pad type, grit rating, and floor material. The abrasiveness of the pads used on the polishing heads can be matched to the specific flooring surface material being treated to maximize the abrasive life of the pad and efficiency of the process for a particular floor material. Weights can also be added to the center shaft 415 to regulate the amount of vertical force exerted upon the floor's surface. The RPM and weight exerted on the floor surface are adjustable within 5% accuracy and can be each respectively adjusted to an optimal exerted force and RPM for the specific type flooring material and type of pad.

Figure 6:
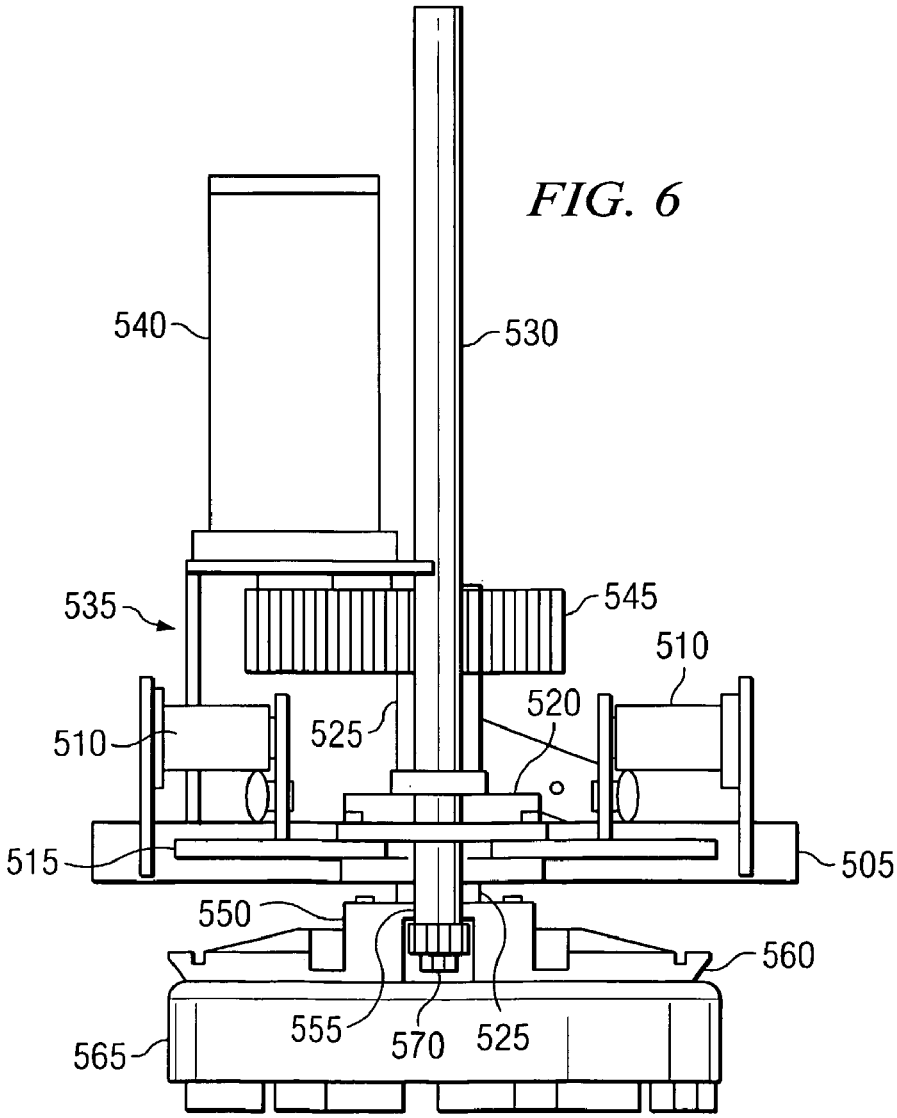
FIG. 6 is a sectional view of FIG. 5.

FIG. 6 is a sectional view of the polishing head used in the invention. The tubular metal frame 505 supports the polishing heads using tensioner arms 510. This attachment method allows the polishing head to "float" over the floor surface to achieve a more uniform finish. Each polishing head floats within the tubular metal frame 505 with the downward force exerted against the floor determined by the total weight of the polishing head assembly (e.g. the components supported by the base plate 515). The base plate 515 attached to the tensioner arms 510 supports the entire polishing head assembly. The bolting flange and flange bearing 520 is bolted onto the center of the base plate 515. A tubular housing 525 extends up and down from the bolting flange and flange bearing 520 passing through the base plate 515. The stationary center shaft 530 passes through the tubular housing 525 and the base plate 515. Weights can be added to the center shaft 530 to obtain the optimal vertical pressure for a given flooring material, and a provision on the vehicle can be used to store the unused weights.

A motor support bracket 535 is attached to the base plate 515 to support a hydraulic motor 540. The hydraulic motor 540 is powered by a pump connected to the vehicle's PTO output shaft and drives a belt sprocket 545 to rotate the tubular housing 525. The belt sprocket 545 rotates the tubular housing 525 at a 2:1 ratio. A bottom bolting flange 550 is welded to the tubular housing 525. A 1 inch thick spacer ring 555 extends down from the bottom bolting flange 550 to mate with an aluminum plate 560, and the planetary drive disc and/or polishing pad 565 mounts onto the aluminum plate 560. When the tubular housing 525 is rotated by the hydraulic motor 540, it counter rotates the planetary drive disc 565. A dispensing head 570 sprays water or polishing solution through the center hole of the planetary drive disc 565 when the machine performs a grinding or polishing operation.

The center water/solution feed provides a continuous source of clean water, polishing solution, or other liquid that lubricates the abrasives in the pads during the cutting process inherent to grinding or polishing the floor surface. Cleaning the flooring surface continually in this manner eliminates contamination of the abrasive material that can cause scratching and produces a superior luster. A center feed also reduces the amount of treatment liquid (water or other liquid solution) required by using the volume of treatment liquid more efficiently. Increased pad life is also achieved by reducing heat, lubricating the pad and flooring interface, and continuously cleaning the abrasive surface. Additionally, a dust-free environment can be maintained making the process safer for workers that would otherwise be exposed to large quantities of silica dust.

Independently suspending the polishing heads allows each polishing head in the gang to absorb shock and approach any irregular surface without deflection of the other heads. This limits abuse to the pad abrasive during grinding operations and increases the efficiency of the cutting process. It also enhances uniformity of the treatment process by eliminating disruptions and irregular interactions between the polishing heads.

Although the preferred embodiment uses a four or eight polishing head configuration on a compact to medium size vehicle, other variations are possible. A sub-compact vehicle weighing less than 1300 pounds with a smaller than 18 gross horsepower engine can be used for a three or even two-polishing-head configuration, but a vehicle weighing under 1000 pounds and having a gross horsepower rating of less than 15 cannot achieve the efficiency that is the main goal of the invention. However, a smaller vehicle may be useful and required for use in multi-story applications. The vehicle can be powered by gasoline, diesel, or liquid propane and is also equipped with an exhaust scrubber to limit emissions for indoor usage.

The invention can be used for treating concrete flooring, terrazzo flooring, natural stone flooring, or any man-made agglomerate or engineered stone flooring. The floor surface can be grinded, polished, scrubbed, or abraded using fiber, nylon, cloth, steel wool, or diamond-impregnated pads or brushes. It can also be used to antique, distress, or age flooring surfaces or remove preexisting flooring for new surface preparation. It can also be used to apply any chemical specified for the cleaning, polishing, hardening, sealing, stabilizing, stripping, or other surface preparation or treatment of a floor surface and provide any necessary surface treatment required for the chemical to function.

The invention is designed to use planetary drive systems such as designed by Darwin s.r.l. and Coor and Kleever, s.a. A planetary drive disc rotates in one direction while driving multiple satellite counter-rotating discs. A planetary drive disc more efficiently uses the diamond polishing heads compared to a single large disk. The main disc of a planetary drive disc typically is between 16 and 32 inches in diameter, with each satellite pad being 3½ to 10½ inches in diameter. The diamond or other abrasive surface randomly travels over a larger diameter to produce a better finish with no tracking marks using a planetary drive system. Traditional machines with individual, large grinding or polishing pads pass over a floor within their own radius, all too often leaving marks on the floor.

The polishing heads fitted on the invention also vary in construction and composition. Diamond-impregnated pads for coarse grinding are usually composed of industrial diamonds imbedded in a metal matrix that wears away at an optimal rate to expose new diamond. This type of pad will have a very low grit rating and easily removes large protrusions and bumps in a stone or concrete surface. Diamond-impregnated pads for finer grinding and polishing are usually composed of industrial diamonds imbedded in a resin that is molded and hardened to the desired shape and hardness. A thermoplastic and abrasive grit mixture can also be used to form an acceptable polishing pad, with the grit composed of a mixture of hard materials that can include diamond, silicon carbide, aluminum oxide or alumina, cubic boron nitride (CBN), zirconia/alumina alloys, stainless steel, or colloidal silica. Other pad constructions are possible, such as metallic-plastic bonded mixtures or metallic-epoxy bonded mixtures. Coated abrasives pads are another option and are made of abrasive grits bonded to flexible substrates such as paper, cloth, fiber, nylon, or film. Bonding is via resins, glues, or combinations of the two. Pads made of a random, three-dimensional, open-weave, nylon material coated with abrasive may also be used. But diamond-impregnated pads are superior to other types, because a smoother grit rating will remove more material compared to other pad types with much coarser grit ratings. This makes diamond-impregnated pads far superior, since a two step grinding and polishing process may achieve the same grade of finish that requires four or more steps using the alternate types.

Figure 7:
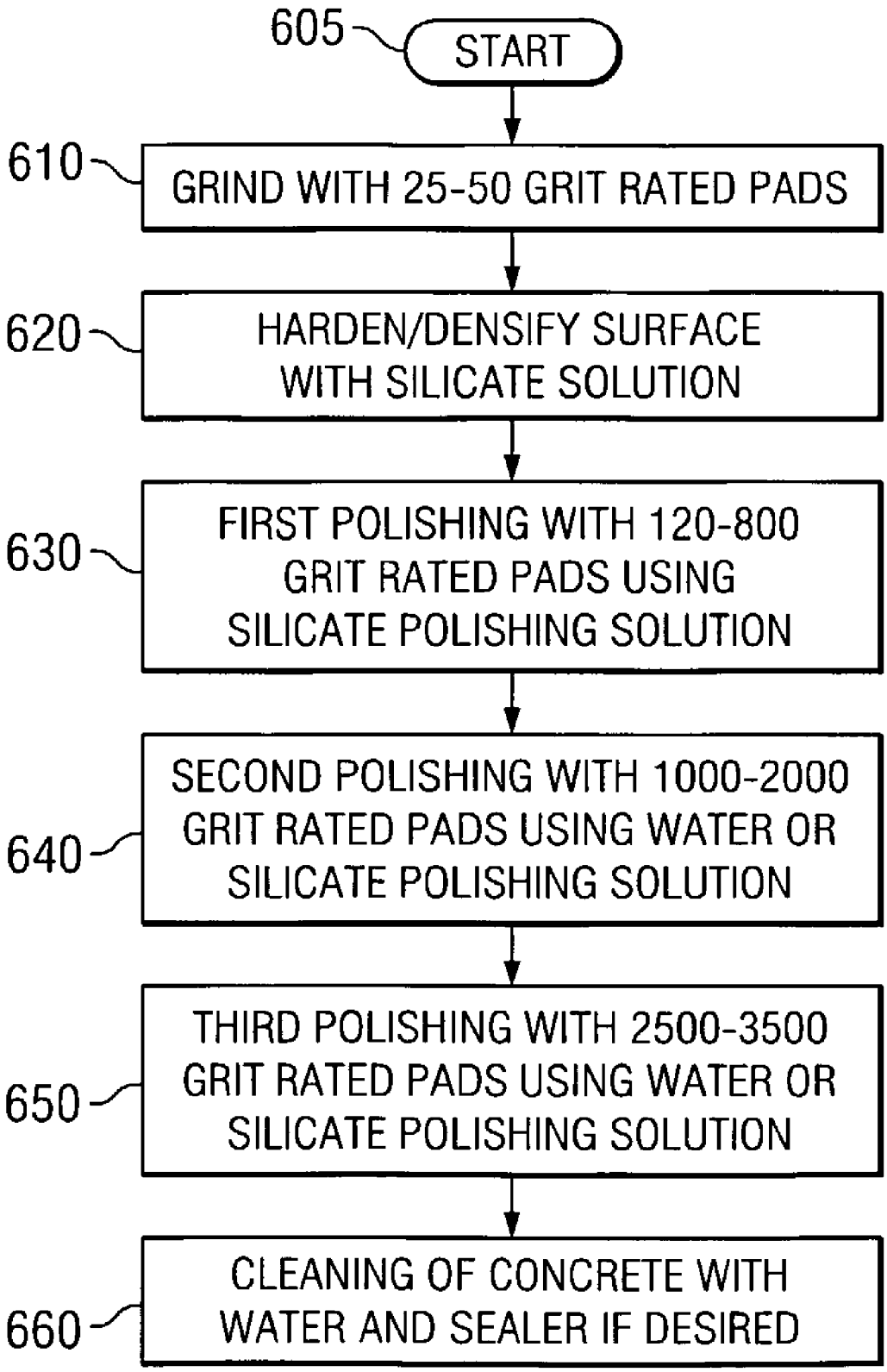
FIG. 7 is a process diagram for an example polishing operation using the invention.

FIG. 7 sets forth an example process diagram for polishing concrete or other similar materials using diamond-impregnated polishing pads. The process starts at 605. In step 610, the concrete floor is ground with 25-50 grit rated pads. This removes bumps and other imperfections left during the pouring and curing steps of concrete placement. Step 620 is to harden or densify the surface with a silicate mixture. Sodium silicate, lithium silicate, fluorosilicate, siloxane, silazanes, silane, or any other silicon chemical solution that reacts with cement bonding sites to chemically bond with the cement matrix is applied to the flooring and reacts with the calcium hydroxide cement matrix to produce additional cementitious material. This material fills in pores, small gaps, and fissures in the surface of the concrete and improves the silicon bonds in the cement to close up pores and produce a smoother, harder, and more durable surface. Step 630 is a first grinding and polishing step performed using a 100 to 500 grit rated pad and a silicate polishing solution. This polishing compound is typically diluted after initial grinding compared to the earlier application.

For many industrial and commercial applications, the second step achieves an acceptable shine and does not require any further treatment. For other application, additional polishing is required or desired. At step 640, a second polishing step performed using 1000 to 2000 grit rated pads and water or a silicate polishing solution achieves an even smoother finish. A third polishing step performed using 2500 to 3500 grit pads and water or a silicate polishing solution in step 650 achieves the smoothest finish, comparable to glass at a 3000 or better grit rating.

The invention permits these levels of grinding and polishing to be accomplished in just two operating passes using the two gang module. The first steps of grinding 610, hardening/densifying the surface 620, and first polishing 630 can be done in a single operation using the two gang module, with the second polishing 640 and third polishing 650 accomplished in a second operation. The final step 660 is cleaning the concrete with water and a sealer if desired, but a finely polished concrete surface will not require any type of sealer. Numerous treatment options and variations for grinding, polishing, or refinishing concrete and other flooring materials are possible, and the invention is intended to provide complimentary grinding and polishing operations required for these different options.

While the invention has been particularly shown and described with respect to preferred embodiments, it will be readily understood that minor changes in the details of the invention may be made without departing from the spirit of the invention.

Having described the invention, we claim:

1. An apparatus for treating a floor surface comprising:

a vehicle equipped with a power output shaft and front loader arms, said front loader arms having multiple axes of articulation defined by at least one pivot point at the attachment joint of the loader arms to the vehicle, at least one pivot point at the attachment point of the loader arms to a polishing module and at least one pivot point on the loader arms is located proximate to midway between the pivot point attachment to the vehicle and the pivoting attachment point to the polishing module;

a polishing module having a support structure coupled to the loader arms and at least two polishing heads coupled to the power output shaft, each polishing head attached to the polishing module so as to rotate over a floor surface during the polishing operation, and the polishing module mounted on the loader arms at a pivoting attachment point to permit vertical movement and rotation of the module including lifting and pivoting, on said axes of articulation, the polishing module to expose the polishing heads; and a polishing pad attached to the polishing head, said polishing head individually powered using the power output shaft to rotate the attached polishing pad in contact with the floor surface.

2. The apparatus for treating a floor surface of claim 1 further comprising: an adjustable mechanism to provide an optimal force for a specific flooring material.

3. The apparatus for treating a floor surface of claim 1 further comprising:

a liquid-filled tank mounted on the rear of the vehicle supplying liquid to a center feed line passing through the center of the polishing head for dispensing a liquid solution.

4. The apparatus for treating a floor surface of claim 1 further comprising:

a center feed line passing though the center of the polishing head for dispensing a liquid solution.

5. The apparatus for treating a floor surface of claim 3 wherein the liquid solution is a treatment solution containing a silicon-based chemical that reacts to fill in pores and gaps in the floor material.

6. The apparatus for treating a floor surface of claim 4 wherein the liquid solution is a treatment solution containing a silicon-based chemical that reacts to fill in pores and gaps in the floor material.

7. The apparatus for grinding or polishing a floor surface of claim 1 further comprising:

a vacuum system feeding into a tank coupled to the vehicle vacuuming up slurry containing liquid applied using the center feed.

8. The apparatus for grinding or polishing a floor surface of claim 1 wherein the vehicle is a vehicle possessing an engine with an output shaft having a horsepower rating greater than or equal to 15.

9. The apparatus for grinding or polishing a floor surface of claim 1 wherein the vehicle is a vehicle with a base weight of more than 1000 pounds.

10. The apparatus for grinding or polishing a floor surface of claim 1 wherein each polishing head is individually powered by a separate hydraulic motor operated by a hydraulic pump coupled to the power output shaft.

11. The apparatus for grinding or polishing a floor surface of claim 1 wherein each polishing head is independently suspended from a common frame allowing each polishing head freedom of axial motion.

12. An apparatus for treating a floor surface comprising:

a vehicle having loader arms and a polishing module coupled to the loader arms and driven by an output power shaft, said output power shaft being driven by a power source on said vehicle, and said polishing module having at least two polishing heads, each polishing head attached to the polishing module and capable of rotating over a floor surface during a polishing operation, said polishing module coupled to the loader arms to allow vertical movement and pivoting of the of the polishing module including lifting and pivoting the module to expose the polishing head, said lifting and pivoting of the module using pivot joints on the loader arms having at least three axes of articulation on the loader arms, using a pivot joint at an attachment point to the vehicle, a pivot joint at the attachment point for the polishing head module, and at least one pivot joint on each loader arm located between the attachment point to the vehicle and the attachment point for the polishing head module;

a drive assembly comprising a hydraulic motor mounted to the polishing module rotating the polishing head, said polishing head having a center feed line for dispensing a liquid and said drive assembly capable of driving two or more polishing pads mounted into a planetary or flat plate disc;

a tank containing said liquid coupled to the vehicle and coupled to the center feed line; and each polishing head powered individually to rotate by the power output shaft to achieve an adjustable rotation rate.

13. The apparatus for treating a floor surface of claim 12 further comprising:

a first grouping of polishing heads each fitted with an identical set of pads having a first grit rating;

a second grouping of polishing heads each fitted with an identical set of pads having a second grit rating; and an operator driving the vehicle and adjusting the rotation and vertical force of the pads to simultaneously achieve a dissimilar floor treatment between the two groupings sets in a single operating pass over a floor surface.

14. The apparatus for treating a floor surface of claim 12 further comprising:

a vacuum system vacuuming generated waste slurry that includes liquid dispensed from the center feed into a tank coupled to the vehicle.

15. The apparatus for treating a floor surface of claim 12 wherein the dispensed liquid is a silicone-based solution.

16. The apparatus for treating a floor surface of claim 12 further comprising:

an adjustable mechanism to exert an optimal downward force against a floor for the specific floor material and treatment.

17. The apparatus for treating a floor surface of claim 12 wherein the vehicle has a base weight of over 1200 pounds and powered by an engine with a gross horsepower rating greater than or equal to 18.

18. The apparatus for treating a floor surface of claim 12 wherein an exhaust scrubber cleans the engine exhaust.

19. A method for treating a floor surface comprising the steps of:

providing a vehicle having front loader arms and a power source;

attaching a first polishing head module to the front loader arms, said module consisting of a metal frame with at least two polishing heads mounted on the metal frame, each of said polishing heads separately coupled to a hydraulic motor rotating said polishing head to rotate over the floor surface during the treatment operation;

providing at least three axes of articulation on the loader arms, using a pivot joint at an attachment point to the vehicle, a pivot joint at the attachment point for the polishing head module, and at least one pivot joint on the loader arm located between the attachment point to the vehicle and the attachment point for the polishing head module;

attaching polishing pads to said polishing heads so that said pads make contact with a floor surface; and dispensing a liquid from a center feed line located in the center of the polishing heads during the treatment operation.

20. The method for treating a floor surface of claim 19 further comprising the steps of:

attaching a second polishing head module to the front loader arms, said module consisting of a metal frame with at least two polishing heads mounted on the metal frame, said polishing head rotating over the floor surface during the treatment operation;

attaching a first set of identical pads with a first grit rating to the first polishing head module and a second set of identical pads with a second grit rating to the second polishing head module; and operating the first and second sets of pads to simultaneously achieve a dissimilar floor treatment operation between the two pad sets in a single pass over a floor surface.

21. The method for treating a floor surface of claim 19 further comprising the steps of:

providing a power source with an engine horsepower rating greater than or equal to 18 that generates a horsepower output of greater than or equal to 15 at the output shaft.

22. The method for treating a floor surface of claim 19 further comprising the steps of:

impregnating a polishing pad with industrial diamonds; and mounting at least two polishing pads to a planetary disc or a flat plate disc attached to at least one of the polishing heads.

23. The method for treating a floor surface of claim 19 further comprising the step of:

adjusting the downward force against the floor surface to provide an optimal contact with a specific floor material and treatment.

* * * * *